US009822476B2

(12) United States Patent
Janke et al.

(10) Patent No.: US 9,822,476 B2
(45) Date of Patent: Nov. 21, 2017

(54) LAUNDRY TREATING APPLIANCE AND METHOD OF OPERATION

(71) Applicant: WHIRLPOOL CORPORATION, Benton Harbor, MI (US)

(72) Inventors: Brian P. Janke, Saint Joseph, MI (US); Peter J. Richmond, Berrien Springs, MI (US); Peter E. Zasowski, Yantis, TX (US)

(73) Assignee: Whirlpool Corporation, Benton Harbor, MI (US)

( * ) Notice: Subject to any disclaimer, the term of this patent is extended or adjusted under 35 U.S.C. 154(b) by 54 days.

(21) Appl. No.: 14/874,792

(22) Filed: Oct. 5, 2015

(65) Prior Publication Data

US 2016/0024704 A1 Jan. 28, 2016

Related U.S. Application Data

(62) Division of application No. 13/633,181, filed on Oct. 2, 2012, now Pat. No. 9,200,400.

(51) Int. Cl.

| | |
|---|---|
| ***D06F 37/20*** | (2006.01) |
| ***D06F 33/02*** | (2006.01) |
| ***D06F 39/00*** | (2006.01) |
| ***D06F 23/04*** | (2006.01) |

(52) U.S. Cl.

CPC ..... *D06F 37/203* (2013.01); *D06F 23/04* (2013.01); *D06F 33/02* (2013.01); *D06F 39/003* (2013.01); *D06F 39/005* (2013.01); *D06F 2202/10* (2013.01); *D06F 2204/065* (2013.01); *D06F 2222/00* (2013.01)

(58) Field of Classification Search

CPC ..... D06F 33/02; D06F 37/203; D06F 39/003; D06F 39/005; D06F 2202/10; D06F 2204/065; D06F 2222/00

See application file for complete search history.

(56) References Cited

U.S. PATENT DOCUMENTS

| | | | | |
|---|---|---|---|---|
| 4,782,544 | A | 11/1988 | Nystuen et al. | |
| 6,505,369 | B1 * | 1/2003 | Weinmann | D06F 37/203 68/12.01 |
| 7,451,510 | B2 | 11/2008 | Lee | |
| 7,707,671 | B2 | 5/2010 | Koo | |
| 8,938,835 | B2 * | 1/2015 | Bae | D06F 35/006 8/158 |
| 2002/0020196 | A1 | 2/2002 | Kakuda et al. | |
| 2005/0016227 | A1 | 1/2005 | Lee | |

(Continued)

FOREIGN PATENT DOCUMENTS

| | | | |
|---|---|---|---|
| DE | 3416639 | A1 | 11/1985 |
| DE | 4229646 | A1 | 3/1994 |
| DE | 112005000078 | T5 | 8/2006 |

OTHER PUBLICATIONS

German Search Report for Counterpart DE102013108441.9, dated Jun. 18, 2014.

*Primary Examiner* — Joseph L Perrin

(57) ABSTRACT

A laundry treating appliance for treating a laundry load according to at least one cycle of operation and a method of operating a laundry treating appliance to control the rotation of the drum to distribute the laundry load with an acceptable amount of imbalance such that the laundry treating appliance may be operated in an effective and efficient manner.

20 Claims, 4 Drawing Sheets

(56) References Cited

U.S. PATENT DOCUMENTS

| | | | | |
|---|---|---|---|---|
| 2005/0108830 | A1 | 5/2005 | Park et al. | |
| 2005/0204482 | A1 | 9/2005 | Murray et al. | |
| 2009/0300852 | A1 | 12/2009 | Bae et al. | |
| 2009/0307851 | A1 | 12/2009 | Bae et al. | |
| 2010/0000022 | A1 | 1/2010 | Hendrickson et al. | |
| 2010/0000024 | A1 | 1/2010 | Hendrickson et al. | |
| 2010/0000264 | A1 | 1/2010 | Luckman et al. | |
| 2010/0000573 | A1 | 1/2010 | Hendrickson et al. | |
| 2010/0000581 | A1 | 1/2010 | Doyle et al. | |
| 2010/0000586 | A1 | 1/2010 | Hendrickson | |
| 2010/0037401 | A1 | 2/2010 | Bae et al. | |
| 2010/0263136 | A1 | 10/2010 | Ashrafzadeh et al. | |
| 2011/0061172 | A1 | 3/2011 | Koo et al. | |
| 2012/0144600 | A1 | 6/2012 | Ashrafzadeh et al. | |
| 2012/0266389 | A1 | 10/2012 | Ihne et al. | |
| 2013/0160498 | A1* | 6/2013 | Erickson | D06F 37/203 68/12.02 |

* cited by examiner

LAUNDRY TREATING APPLIANCE AND METHOD OF OPERATION

CROSS-REFERENCE TO RELATED APPLICATIONS

This application is a divisional of U.S. patent application Ser. No. 13/633,181, filed Oct. 2, 2012, now U.S. Pat. No. 9,200,400, issued Dec. 1, 2015, which is incorporated herein by reference in its entirety.

BACKGROUND

Laundry treating appliances, such as clothes washers, refreshers, and non-aqueous systems, may have a configuration based on a rotating drum that defines a treating chamber in which laundry items are placed for treating according to one or more cycles of operation. The laundry treating appliance may have a controller that implements the cycles of operation having one or more operating parameters. The controller may control a motor to rotate the drum according to one of the cycles of operation. The controller may control the motor to rotate the drum at the same speeds for a give cycle of operation regardless of the characteristics of the laundry items.

BRIEF SUMMARY

An embodiment of the invention relates to a, laundry treating appliance for treating a laundry load according to at least one cycle of operation, including a rotatable drum at least partially defining a treating chamber for receiving the laundry load for treatment, a motor operably coupled to the drum for rotating the drum, load sensor providing a load output indicative of an amount of the laundry load in the treating chamber, an imbalance sensor providing an imbalance output indicative of an amount of imbalance in the laundry load, and a controller receiving as input the load output and the imbalance output and controlling the rotation of the drum to distribute the laundry load with an acceptable amount of imbalance by: a) setting an acceleration profile based on the load output, b) accelerating the drum according to the acceleration profile from a non-satellizing speed to a satellizing speed, c) decelerating the drum from the satellizing speed to a non-satellizing speed when the imbalance output is unacceptable, d) re-setting the acceleration profile and repeating a)-d) until the imbalance is acceptable, and e) storing the acceleration profile for a corresponding load amount when the imbalance is acceptable to define an acceptable acceleration profile.

DESCRIPTION OF EMBODIMENTS OF THE INVENTION

Figure 1:
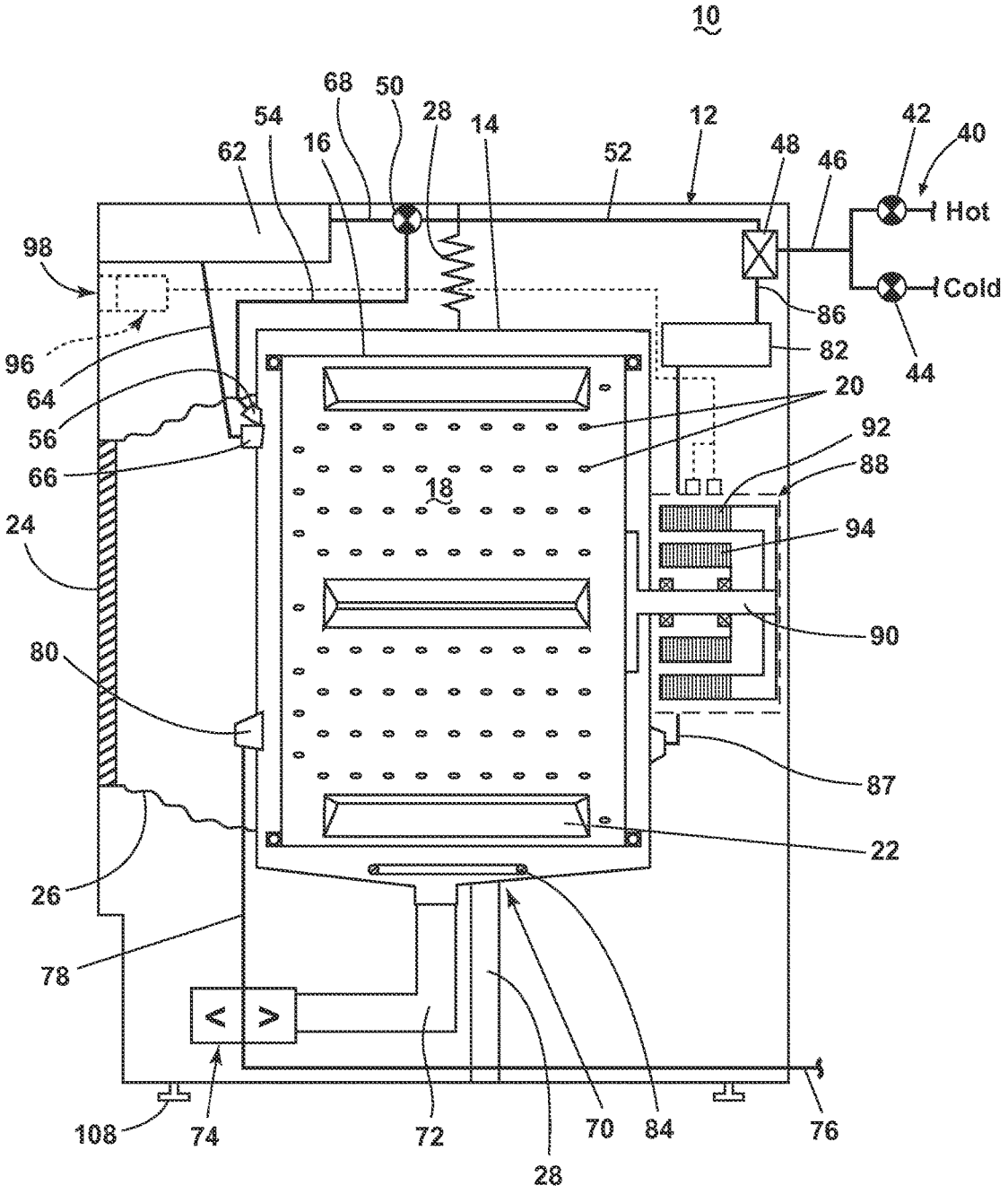
FIG. 1 is a schematic view of a laundry treating appliance in the form of a washing machine according to a first embodiment of the invention.

FIG. 1 is a schematic view of a laundry treating appliance according to a first embodiment of the invention. The laundry treating appliance may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the invention for the laundry holding system to comprise only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single and bulk dispenser. Non-limiting examples of suitable dispensers are disclosed in U.S. Pub. No. 2010/0000022 to Hendrickson et al., filed Jul. 1, 2008, now U.S. Pat. No. 8,196,441, issued Jun. 12, 2012, entitled "Household Cleaning Appliance with a Dispensing System Operable Between a Single Use Dispensing System and a Bulk Dispensing System," U.S. Pub. No. 2010/0000024 to Hendrickson et al., filed Jul. 1, 2008, now U.S. Pat. No. 8,388,695, issued Mar. 5, 2013, entitled "Apparatus and Method for Controlling Laundering Cycle by Sensing Wash Aid Concentration," U.S. Pub. No. 2010/0000573 to Hendrickson et al., filed Jul. 1, 2008, now U.S. Pat. No. 8,397,328, issued Mar. 19, 2013, entitled "Apparatus and Method for Controlling Concentration of Wash Aid in Wash Liquid," U.S. Pub. No. 2010/0000581 to Doyle et al., filed Jul. 1, 2008, now U.S. Pat. No. 8,813,526, Aug. 26, 2014, entitled "Water Flow Paths in a Household Cleaning Appliance with Single Use and Bulk Dispensing," U.S. Pub. No. 2010/0000264 to Luckman et al., filed Jul. 1, 2008, entitled "Method for Converting a Household Cleaning Appliance with a Non-Bulk Dispensing System to a Household Cleaning Appliance with a Bulk Dispensing System," U.S. Pub. No. 2010/0000586 to Hendrickson, filed Jun. 23, 2009, now U.S. Pat. No. 8,397,544, issued Mar. 19, 2013 entitled "Household Cleaning Appliance with a Single Water Flow Path for Both Non-Bulk and Bulk Dispensing," and application Ser. No. 13/093,132, filed Apr. 25, 2011, now U.S. Pat. No. 8,438,881, issued May 14, 2013, entitled "Method and Apparatus for Dispensing Treating Chemistry in a Laundry Treating Appliance," which are herein incorporated by reference in full.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88, which may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
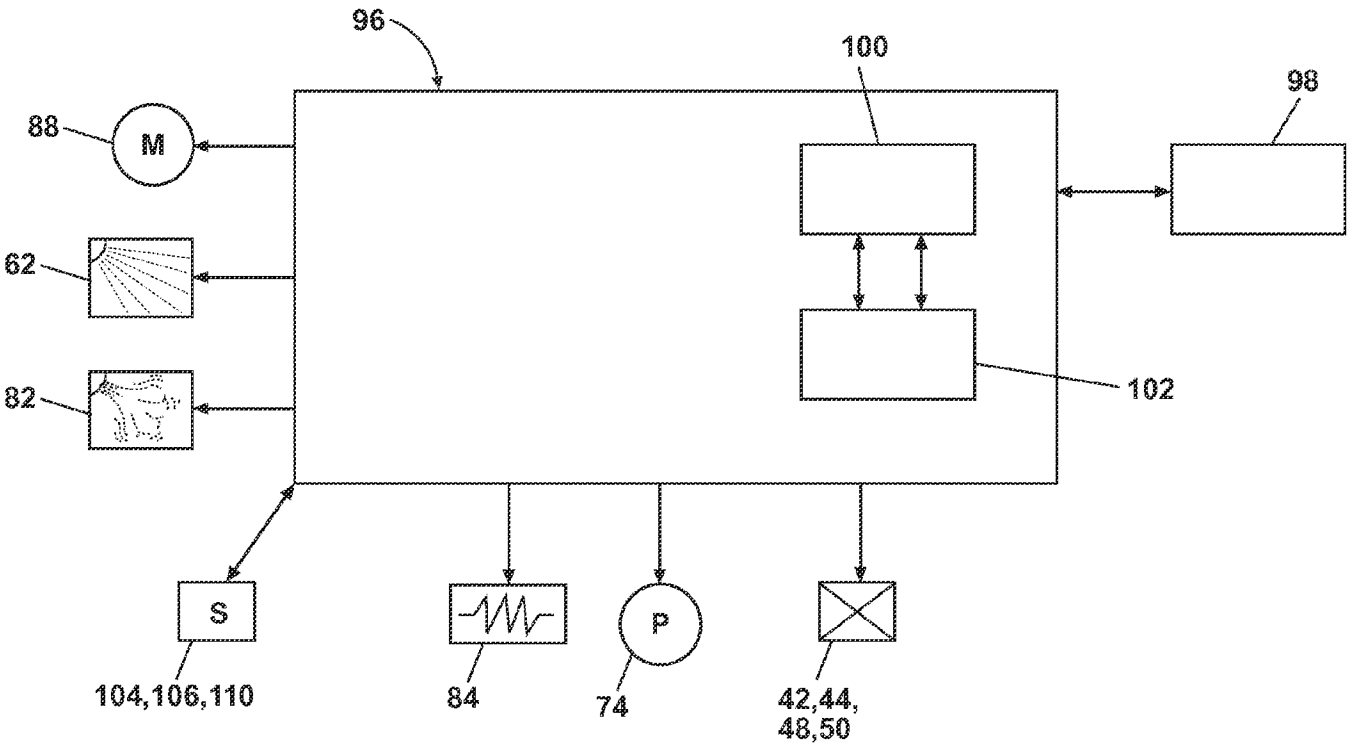
FIG. 2 is a schematic of a control system of the laundry treating appliance of FIG. 1 according to the first embodiment of the invention.

As illustrated in FIG. 2, the controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor and a motor torque sensor, which may be used to determine a variety of system and laundry characteristics, such as laundry load inertia or mass.

In one example, one or more load amount sensors 106 may also be included in the washing machine 10 and may be positioned in any suitable location for detecting the amount of laundry, either quantitative (inertia, mass, weight, etc.) or qualitative (small, medium, large, etc.) within the treating chamber 18. By way of non-limiting example, it is contemplated that the amount of laundry in the treating chamber may be determined based on the weight of the laundry and/or the volume of laundry in the treating chamber. Thus, the one or more load amount sensors 106 may output a signal indicative of either the weight of the laundry load in the treating chamber 18 or the volume of the laundry load in the treating chamber 18.

The one or more load amount sensors 106 may be any suitable type of sensor capable of measuring the weight or volume of laundry in the treating chamber 18. Non-limiting examples of load amount sensors 106 for measuring the weight of the laundry may include load volume, pressure, or force transducers which may include, for example, load cells and strain gauges. It has been contemplated that the one or more such load amount sensors 106 may be operably coupled to the suspension system 28 to sense the weight borne by the suspension system 28. The weight borne by the suspension system 28 correlates to the weight of the laundry loaded into the treating chamber 18 such that the load amount sensor 106 may indicate the weight of the laundry loaded in the treating chamber 18. In the case of a suitable load amount sensor 106 for determining volume it is contemplated that an IR or optical based sensor may be used to determine the volume of laundry located in the treating chamber 18.

Alternatively, it has been contemplated that the washing machine 10 may have one or more pairs of feet 108 (FIG. 1) extending from the cabinet 12 and supporting the cabinet 12 on the floor and that a weight sensor (not shown) may be operably coupled to at least one of the feet 108 to sense the weight borne by that foot 108, which correlates to the weight of the laundry loaded into the treating chamber 18. In another example, the amount of laundry within the treating chamber 18 may be determined based on motor sensor output, such as output from a motor torque sensor. The motor torque is a function of the inertia of the rotating drum and laundry. There are many known methods for determining the load inertia, and thus the load mass, based on the motor torque. It will be understood that the details of the load amount sensors are not germane to the embodiments of the invention and that any suitable method and sensors may be used to determine the amount of laundry.

As another example, an imbalance sensor 110 may also be included in the washing machine 10 and may be positioned in any suitable location for detecting and indicating an amount of imbalance in the laundry load. By way of non-limiting example, it is contemplated that the amount of imbalance in the laundry load may be determined using accelerometers, load sensors, ball balance rings, or mass sensors. Thus, the imbalance sensors 110 may output a signal indicative of the amount of imbalance. It is also contemplated that the amount of load imbalance may also be determined based on a signal indicative of the torque of the motor 88.

Specifically, the analysis of the motor torque signal in the frequency domain may provide valuable information regarding the amount of imbalance.

The previously described washing machine 10 may be used to implement one or more embodiments of the invention. The embodiments of the method of the invention may be used to control the operation of the washing machine 10 to control the rotation of the drum to distribute the laundry within the laundry treating chamber 18 to provide for an acceptable amount of imbalance.

Prior to describing a method of operation, a brief summary of the underlying physical phenomena may be useful to aid in the overall understanding. The motor 88 may rotate the drum 16 at various speeds in either rotational direction. In particular, the motor 88 can rotate the drum 16 at speeds to effect various types of laundry load 112 movement inside the drum 16. For example, the laundry load may undergo at least one of tumbling, rolling (also called balling), sliding, satellizing (also called plastering), and combinations thereof. During tumbling, the drum 16 is rotated at a tumbling speed such that the fabric items in the drum 16 rotate with the drum 16 from a lowest location of the drum 16 towards a highest location of the drum 16, but fall back to the lowest location before reaching the highest location. Typically, the centrifugal force applied by the drum to the fabric items at the tumbling speeds is less than about 1G. During satellizing, the motor 88 may rotate the drum 16 at rotational speeds, i.e. a spin speed, wherein the fabric items are held against the inner surface of the drum and rotate with the drum 16 without falling. This is known as the laundry being satellized or plastered against the drum. Typically, the force applied to the fabric items at the satellizing speeds is greater than or about equal to 1G. For a horizontal axis washing machine 10, the drum 16 may rotate about an axis that is inclined relative to the horizontal, in which case the term "1G" refers to the vertical component of the centrifugal force vector, and the total magnitude along the centrifugal force vector would therefore be greater than 1G. The terms tumbling, rolling, sliding and satellizing are terms of art that may be used to describe the motion of some or all of the fabric items forming the laundry load. However, not all of the fabric items forming the laundry load need exhibit the motion for the laundry load to be described accordingly. Further, the rotation of the fabric items with the drum 16 may be facilitated by the baffles 22.

Centrifugal force (CF) is a function of a mass (m) of an object (laundry item 116), an angular velocity (ω) of the object, and a distance, or radius (r) at which the object is located with respect to an axis of rotation, or a drum axis. Specifically, the equation for the centrifugal force (CF) acting on a laundry item 116 within the drum 16 is:

$$CF=m*\omega^2*r \quad (1)$$

The centrifugal force (CF) acting on any single item 116 in the laundry load 112 can be modeled by the distance the center of gravity of that item 116 is from the axis of rotation of the drum 16. Thus, when the laundry items 116 are stacked upon each other, which is often the case, those items having a center of gravity closer to the axis of rotation experience a smaller magnitude centrifugal force (CF) than those items having a center of gravity farther away. It is possible to slow the speed of rotation of the drum 16 such that the closer items 116 will experience a centrifugal force (CF) less than the force required to satellize them, permitting them to tumble, while the farther away items 116 still experience a centrifugal force (CF) equal to or greater than the force required to satellize them, retaining them in a fixed position relative to the drum 16. Using such a control of the speed of the drum 16, it is possible to control the speed of the drum 16 such that the closer items 116 may tumble within the drum 16 while the farther items 116 remain fixed. This method may be used to eliminate an imbalance 114 caused by a mass of stacked laundry items 116 because an imbalance is often caused by a localized "piling" of items 116.

As used in this description, the elimination of the imbalance 114 means that the imbalance 114 is reduced below a maximum magnitude suitable for the operating conditions. It does not require a complete removal of the imbalance 114. In many cases, the suspension system 28 in the washing machine 10 may accommodate a certain amount of imbalance 114. Thus, it is not necessary to completely remove the entire imbalance 114.

Figure 3:
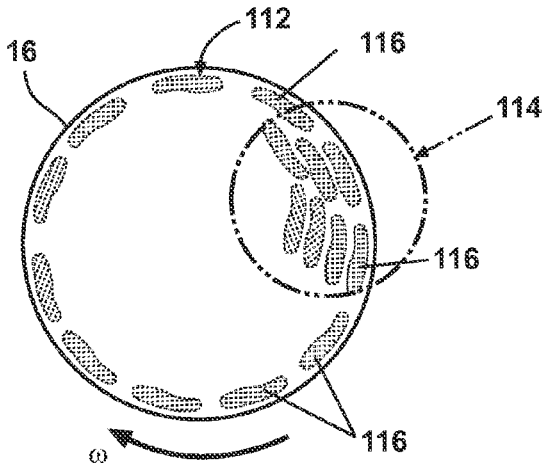
FIG. 3 illustrates a laundry load, including an imbalance, in a drum of the laundry treating appliance of FIG. 1, during a spin phase of a cycle of operation.
Figure 4:
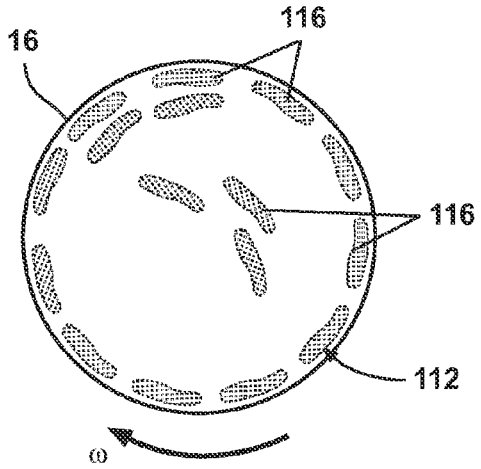
FIG. 4 illustrates the position of the laundry load in the drum as it is redistributed during the cycle of operation.
Figure 5:
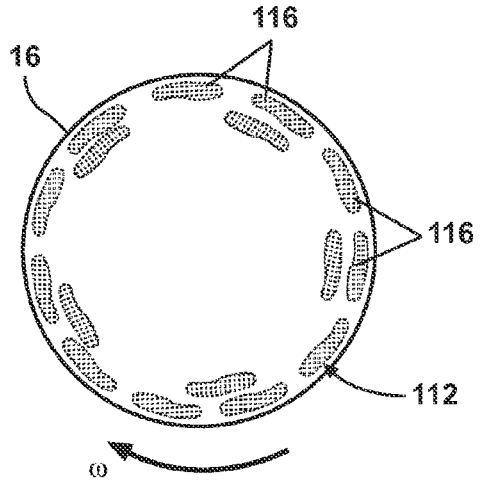
FIG. 5 illustrates the position of the laundry load in the drum after the imbalance has been sufficiently eliminated.

FIGS. 3-5 graphically illustrate such a method. Beginning with FIG. 3, an unequally distributed laundry load 112 is shown in the treating chamber 18 defined by the drum 16 during a spin phase wherein the treating chamber 18 is rotated at a spin speed sufficient to apply a centrifugal force greater than that required to satellize the entire laundry load 112, thereby, satellizing the laundry load 112. However, it can also be seen that not all the laundry items 116 that make up the laundry load 112 are located an equal distance from the axis of rotation. Following the above equation, the centrifugal force (CF) acting on each laundry item 116 in the treating chamber 18 is proportional to the distance from the axis of rotation. Thus, along the radius of the treating chamber 18, the centrifugal force (CF) exhibited on the individual laundry items 116 will vary. Accordingly, the closer the laundry item 116 lies to the axis of rotation, the smaller the centrifugal force (CF) acting thereon. Therefore, to satellize all of the laundry items 116, the treating chamber 18 must be rotated at a spin speed sufficient that the centrifugal force (CF) acting on all of the laundry items 116 is greater than the gravity force acting thereon. It can be correlated that the laundry items 116 pressed against the inner peripheral wall of the treating chamber 18 experience greater centrifugal force (CF) than the laundry items 116 lying closer to the axis of rotation. In other words, during the spin phase and satellization of the laundry load 112, all of the laundry items 116 are experiencing centrifugal force greater than the force required to satellize them, yet not all of the laundry items 116 are experiencing the same centrifugal force (CF).

The imbalance 114 can be seen in the treating chamber 18, as circled in FIG. 3. The imbalance 114 is due to the uneven distribution of the laundry items 116 within the treating chamber 18. Further, the laundry items 116 that create the imbalance 114 will necessarily be those laundry items 116 that are closest to the axis of rotation.

FIG. 4 illustrates the position of the laundry load 112 in the treating chamber 18 during a redistribution phase wherein the treating chamber 18 is slowed from the speed of FIG. 3 and rotated at a speed such that some of the laundry items 116 experience less than a centrifugal force required to satellize them, while the remaining laundry items 116 experience a centrifugal force required to satellize them or greater than a centrifugal force required to satellize them. According to the principals described above, as the rotational speed of the treating chamber 18 is reduced, the laundry item 116 or items that contributed to the imbalance 114 will begin to tumble and will be redistributed.

Upon redistribution, the treating chamber 18 may be accelerated once again to a speed sufficient to satellize all of the laundry items 116. FIG. 5 illustrates the position where the imbalance 114 is eliminated by a sufficient redistribution and the rotational speed of the treating chamber 18 has been increased again to the spin speed sufficient to satellize the entire laundry load 112.

Figure 6:
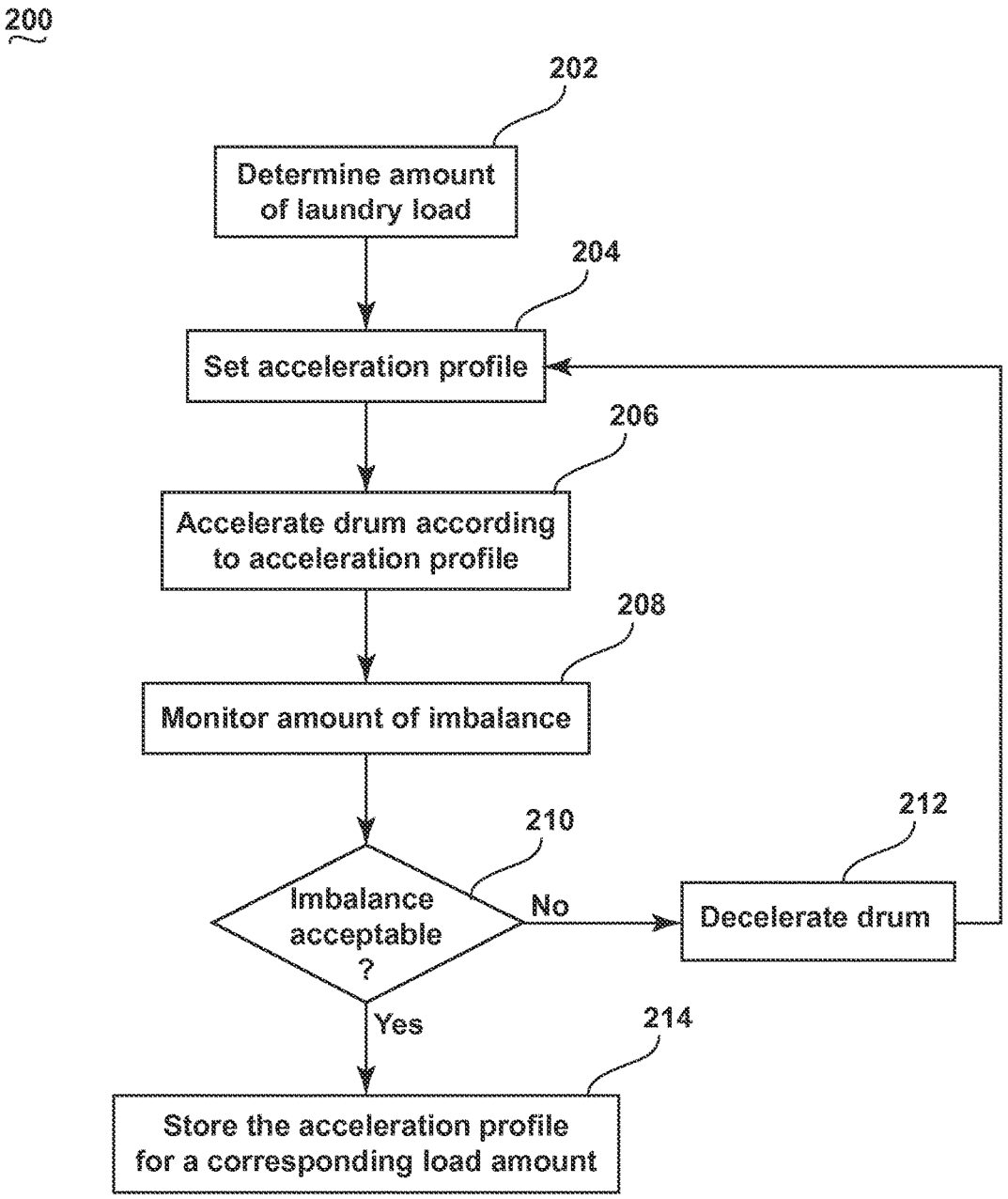
FIG. 6 is a flow chart illustrating a method of controlling rotation of a drum of the washing machine according to a second embodiment of the invention.

Referring now to FIG. 6, a flow chart of a method 200 for controlling the speed of the motor 88 to control the rotational speed of the drum 16 in the washing machine 10 is illustrated. The sequence of steps depicted for this method is for illustrative purposes only, and is not meant to limit the method in any way as it is understood that the steps may proceed in a different logical order or additional or intervening steps may be included without detracting from the invention. The method 200 starts with assuming that the user has placed one or more laundry items 116 for treatment within the treating chamber 18 and selected a cycle of operation through the user interface 98. The method 200 may be implemented during any portion of a cycle of operation or may be implemented as a separate cycle of operation.

At 202, the controller 96 may determine an amount of the laundry load within the treating chamber 18. The amount of laundry may be qualitative or quantitative. For example, a qualitative determination of the laundry amount may include determining whether the laundry is an extra-small, small, medium, large or extra-large load, or any other suitable qualitative grouping. A quantitative determination may include determining a weight or volume of the laundry within the treating chamber 18. The amount of laundry may be determined manually based on user input through the user interface 98 or automatically by the washing machine 10 such as through the load amount sensors 106. The manner in which the amount of laundry is determined is not germane to the embodiments of the invention.

At 204, an acceleration profile may be set by the controller 96 based on the amount of the laundry load determined at 202. The acceleration profile may include at least one predetermined acceleration rate based on the amount of laundry. For example, the acceleration rate may be found by the controller 96 conducting a table look-up of an acceleration rate corresponding to the determined amount of laundry. In conducting a table look-up the controller 96 may determine the acceleration rate based on where the determined amount of laundry falls within a range of amounts of laundry. For example, a predetermined acceleration rate may be provided if the load amount falls in the range of an extra-small to a small load amount.

While it is contemplated that the acceleration profile may be a single acceleration rate, it may include multiple acceleration rates that are sequentially implemented. The switching from one acceleration rate may be either or both time-based or speed-based and may also be driven by any other input or sensor. Similarly, the application of the acceleration profile may also be either or both time-based or speed-based.

At 206, the controller 96 may accelerate the drum 16 through operation of the motor 88 according to the acceleration profile from a non-satellizing speed to a satellizing speed. While the drum is being accelerated the controller 96 may monitor the amount of imbalance, as indicated at 208. More specially, the controller 96 may provide the acceleration profile or a similar speed profile control signal to the motor 88 to control the acceleration of the drum 16 to the satellizing speed. During this time, the controller 96 may receive one or more signals from an imbalance sensor 110 and may monitor the amount of imbalance based on such a signal.

Alternatively or in addition to the signal from the imbalance sensor 110, the controller 96 may receive one or more signals from the motor 88. From such motor signals, the controller 96 may determine an imbalance based on the motor torque and may monitor such imbalance as the drum 16 is accelerated according to the acceleration profile. In this manner, monitoring the amount of imbalance may include monitoring the motor torque. More specifically, the controller 96 may monitor the motor torque in the frequency domain as a magnitude of the imbalance may be determined, and then monitored, by analyzing a signal indicative of the torque of the motor 88 in the frequency domain. Analysis of the motor torque signal in the frequency domain may provide valuable information regarding the imbalance, especially as compared to analysis of the motor torque signal in the time domain. The analysis of the motor torque signal in the frequency domain may be done by the controller 96 processing the motor torque signal using a mathematical method, such as a Fast Fourier Transform (FFT) or a Sliding Discrete Fourier Transform (SDFT). Such a determination has been described in application Ser. No. 12/964,763, filed Dec. 10, 2010, now U.S. Pat. No. 8,984,693, issued Mar. 24, 2015, entitled "Method and Apparatus for Redistributing an Imbalance in a Laundry Treating Appliance," which is herein incorporated by reference in full.

At 210, the controller 96 may determine whether the monitored imbalance is acceptable. This may include the controller 96 determining whether the monitored imbalance satisfies a predetermined imbalance amount threshold. The controller 96 may accomplish this by comparing the monitored amount to a predetermined imbalance threshold to see if the monitored amount satisfies the predetermined threshold. To do this, the controller 96 may compare the monitored amount, either continuously or at set time intervals, to the predetermined threshold value. The term "satisfies" the threshold is used herein to mean that the amount of the monitored imbalance satisfies the predetermined threshold, such as being equal to, less than, or greater than the threshold value. It will be understood that such a determination may easily be altered to be satisfied by a positive/negative comparison or a true/false comparison. For example, a less than threshold value can easily be satisfied by applying a greater than test when the data is numerically inverted.

The predetermined threshold value may be determined experimentally and stored in the memory 100 of the controller 96. It has been contemplated that the predetermined amount threshold value may be a predetermined amount range and that the predetermined amount threshold may be satisfied when the monitored amount falls within the predetermined amount range. It has been contemplated that there may be multiple predetermined amount threshold values and that during the comparison it may be determined which of the multiple values is satisfied.

If the amount of imbalance is determined to be unacceptable at 210, then the drum 16 may be decelerated from the satellizing speed to a non-satellizing speed and the acceleration profile may be reset such as at 204. The acceleration of the drum according to the reset acceleration profile, the monitoring of the amount of imbalance, and determining if the imbalance is acceptable may be repeated until the imbalance is determined to be acceptable at 210. The deceleration of the drum may include controlling the motor 88 to decrease the speed of the drum, shutting off power to the motor 88, or dynamically braking the drum 16 with the motor 88. The re-setting of the acceleration profile may include one of increasing and decreasing the acceleration rate. For example, increasing the acceleration rate may occur when the determined amount of laundry resides within a lower half of the range of thee amount of laundry in which the determined amount of laundry falls based on the table look-up. The rate of acceleration that is used may be updated based on the speed that the load is satellized at or the inertia in the drum if that value is known or calculated. In general, larger loads will have higher satellization speeds than smaller loads and based on this information, the ramp rate may be adjusted based on the load amount. For example, different acceleration rates may be used for a load whose satellization speed is calculated to be at 55 RPM as compared to a load whose satellization speed is calculated to be 65 RPM. It is contemplated that the acceleration profile may only be reset after a failed attempt at ramping to the target speed (i.e. only after a distribution is needed).

The deceleration of the drum, resetting of the acceleration profile, and acceleration of the drum according to the reset acceleration profile may include operating the motor 88 such that the speed of the drum 16 is dropped just below the satellizing speed and then brought back up to the satellizing speed such that the speed of the drum 16 oscillates around the satellizing speed, this is sometimes referred to as a short distribution. The deceleration of the drum, resetting of the acceleration profile, and acceleration of the drum according to the reset acceleration profile may include stopping the rotation of the drum 16 altogether and then bringing the drum 16 back up to the satellizing speed at 206 according to the reset acceleration profile, this is sometimes referred to as a long distribution.

It is contemplated that the imbalance may be determined to be acceptable initially without having to redistribute the load. Regardless of whether redistribution takes place or not, when it is determined that the imbalance is acceptable at 210, the acceleration profile may be stored for the corresponding load amount to define an acceptable acceleration profile. For example, the acceleration profile may be stored in the memory 100 of the controller 96. Storing the acceptable acceleration profile may include storing the acceleration rate to define an acceptable acceleration rate. Further, an average of the acceptable acceleration rates may be determined and may be stored. Further, some of the most recent acceptable acceleration rates and the average of those rates may be stored. It is contemplated that if an average is stored that the average may be a running average and/or a sliding average.

It will be understood that the method to control the rotation of the drum to distribute the laundry within the laundry treating chamber 18 to provide for an acceptable amount of imbalance is flexible and that the method 200 illustrated is merely for illustrative purposes. For example, the determining the amount of laundry may include determining a load mass of the laundry load. This may include determining an inertia value indicative of the inertia of the laundry load. The determination of the inertia value may be made during an acceleration ramp of the drum such as when the drum is being accelerated at 206 or at an initial acceleration of the drum used to determine the amount of the laundry load. The controller 96 may determine the inertia value by determining a motor torque and this may be determined based on a motor sensor output, such as output from a motor torque sensor. The motor torque may be a function of the inertia of the rotating drum and laundry load. Generally, the greater the inertia of the rotating drum and laundry, the greater the motor torque. There are many methods for determining the load inertia, and the load mass, based on the motor torque and such a determination method is not germane to the invention.

It is further noted that rarely is it necessary from a practical perspective to actually calculate the value at issue. For example, in the case of the amount of the load, motor torque and/or inertia are typically proportional to the amount, rendering unnecessary to actually calculate the amount. Further, the motor torque and/or inertia are typically proportional to a voltage level of an output signal from a sensor, such as a torque sensor. Thus, to determine the amount of laundry, one need only obtain the voltage value and compare it to a reference voltage value for the corresponding load amount.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

The above described embodiments provided a variety of benefits including that the cycle of operation of the laundry treating appliance may be operated in an effective and efficient manner. More specifically, an imbalance of the laundry load may be determined in real time and the load may be redistributed such that it may be evenly distributed. Further, instead of merely recognizing an imbalance during an acceleration of the drum and lowering the speed to tumble in hopes that the load redistributes well, which leaves a lot to chance and is time consuming the above embodiments allow the laundry treating appliance to learn over time. Thus, in as little time as possible the laundry treating appliance may redistribute the load in order to achieve a spin or plateau speed and avoid tub to cabinet hits during the acceleration process. Further, for a given amount of laundry imbalances may be completely avoided based on learning from previous cycles of operation for that load amount.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance for treating a laundry load according to at least one cycle of operation, comprising:

a rotatable drum at least partially defining a treating chamber for receiving the laundry load for treatment;

a motor operably coupled to the rotatable drum for rotating the rotatable drum;

a load sensor providing a load output indicative of an amount of the laundry load in the treating chamber;

an imbalance sensor providing an imbalance output indicative of an amount of imbalance in the laundry load; and a controller configured to receive as input the load output and the imbalance output and configured to control the rotation of the rotatable drum to distribute the laundry load with an acceptable amount of imbalance by: a) setting an acceleration profile based on the load output, b) accelerating the rotatable drum according to the acceleration profile from a non-satellizing speed to a satellizing speed, c) decelerating the rotatable drum from the satellizing speed to a non-satellizing speed when the imbalance output is unacceptable, d) resetting the acceleration profile to a different acceleration profile and repeating a)-d) until the imbalance is acceptable, and e) storing the different acceleration profile for a corresponding load amount when the imbalance is acceptable to define an acceptable acceleration profile.

2. The laundry treating appliance of claim 1 wherein the acceleration profile comprises at least one acceleration rate.

3. The laundry treating appliance of claim 1 wherein the controller is configured to determine an amount of the laundry load within the treating chamber based on the load output and the acceleration profile is set based on the determined amount.

4. The laundry treating appliance of claim 3 wherein the determining an amount of laundry comprises determining an inertia value indicative of the inertia of the laundry load.

5. The laundry treating appliance of claim 4 wherein the load sensor is a motor torque sensor.

6. The laundry treating appliance of claim 3 wherein the controller is configured to conduct a table look-up of an acceleration rate corresponding to the determined amount of the laundry load and set an acceleration rate based thereon to define the different acceleration profile.

7. The laundry treating appliance of claim 3 wherein the controller is configured to look up a range of an amount of laundry in which the determined amount of the laundry load falls.

8. The laundry treating appliance of claim 7 wherein the controller is configured to re-set the acceleration profile by increasing or decreasing an acceleration rate.

9. The laundry treating appliance of claim 8 wherein the controller is configured to increase the acceleration rate when the determined amount of the laundry load resides within a lower half of the range.

10. The laundry treating appliance of claim 1 wherein the controller is configured to decelerate the rotatable drum by shutting off power to the motor.

11. The laundry treating appliance of claim 1 wherein the controller is configured to decelerate the rotatable drum by operating the motor to dynamically brake the rotatable drum.

12. The laundry treating appliance of claim 1 wherein the load sensor provides a quantitative load output regarding the amount of the laundry in the treating chamber.

13. The laundry treating appliance of claim 12 wherein the load sensor measures a weight or a volume of laundry in the treating chamber.

14. The laundry treating appliance of claim 1 wherein the load sensor provides a qualitative load output regarding the amount of the laundry load.

15. The laundry treating appliance of claim 14 wherein the load output indicates the load amount is small, medium, or large.

16. The laundry treating appliance of claim 1 wherein the imbalance sensor comprises an accelerometer, a load sensor, a ball balance ring, or a mass sensor.

17. The laundry treating appliance of claim 1 wherein the imbalance sensor provides an imbalance output in the form of a motor torque signal, which is indicative of an amount of imbalance in the laundry load.

18. The laundry treating appliance of claim 1 wherein the controller is configured to continuously monitor the imbalance output.

19. The laundry treating appliance of claim 18 wherein the controller is configured to compare the imbalance output to a threshold value to determine when the imbalance output is unacceptable.

20. A laundry treating appliance for treating a laundry load according to at least one cycle of operation, comprising:

a rotatable drum at least partially defining a treating chamber for receiving the laundry load for treatment;

a motor operably coupled to the rotatable drum for rotating the rotatable drum;

a user interface providing a cycle selection output indicative of a user selected cycle of operation;

an imbalance sensor providing an imbalance output indicative of an amount of imbalance in the laundry load; and a controller configured to receive as input the cycle selection output and the imbalance output and configured to control the rotation of the rotatable drum to distribute the laundry load with an acceptable amount of imbalance by: a) setting an initial acceleration profile based on the cycle selection output or a load amount, b) accelerating the rotatable drum according to the acceleration profile from a non-satellizing speed to a satellizing speed, c) decelerating the rotatable drum from the satellizing speed to a non-satellizing speed when the imbalance output is unacceptable, d) re-setting the acceleration profile to a different acceleration profile and repeating a)-d) until the imbalance is acceptable, and e) storing the different acceleration profile for a corresponding cycle of operation when the imbalance is acceptable to define an acceptable acceleration profile.

* * * * *